US006974043B1

(12) United States Patent
Lai

(10) Patent No.: US 6,974,043 B1
(45) Date of Patent: Dec. 13, 2005

(54) FLOOR RACK FOR HOLDING BATHROOM SUNDRIES

(76) Inventor: Ming-Hsiao Lai, No. 8, Lane 2, Kung Chi Village, Ta Tsuen Hsiang, Chang-Hua Hsien (TW)

( * ) Notice: Subject to any disclaimer, the term of this patent is extended or adjusted under 35 U.S.C. 154(b) by 0 days.

(21) Appl. No.: 10/684,006

(22) Filed: Oct. 14, 2003

(51) Int. Cl.[7] ..... A47B 47/00
(52) U.S. Cl. ..... 211/205; 211/107; 211/119.009
(58) Field of Search ..... 211/205, 107, 207, 211/196, 187, 175, 119.009, 181.1; 248/158; 242/597.8; D6/551, 524, 527

(56) References Cited

U.S. PATENT DOCUMENTS 898,263 A * 9/1908 Rice ..... 248/474
1,188,921 A * 6/1916 Finkelstein ..... 223/90
1,525,701 A * 2/1925 Rose et al. ..... 211/196
1,742,164 A * 12/1929 Berke ..... 211/168
3,003,646 A * 10/1961 Wolf ..... 211/107
3,076,557 A * 2/1963 Husted et al. ..... 211/196
3,332,654 A * 7/1967 Jacobson ..... 211/107
3,393,888 A * 7/1968 Henningsgard ..... 248/230.8
3,524,616 A * 8/1970 Marschak ..... 248/188.7
3,995,796 A * 12/1976 Kline ..... 248/121
4,591,420 A * 5/1986 Van Horn ..... 204/297.1
5,487,476 A * 1/1996 Barfield ..... 211/85.23
5,855,286 A * 1/1999 Zaid ..... 211/87.01
D406,960 S * 3/1999 Zaid ..... D6/464
6,575,316 B2 * 6/2003 Lin ..... 211/205

* cited by examiner

*Primary Examiner*—Jennifer E. Novosad
(74) *Attorney, Agent, or Firm*—Egbert Law Offices

(57) ABSTRACT

A floor rack is designed to hold bathroom sundries and is formed of a base, an upright support rod extending from the base, and a plurality of holders for holding the bathroom sundries. The holders are fastened detachably and interchangeably with the upright support rod.

3 Claims, 8 Drawing Sheets

FLOOR RACK FOR HOLDING BATHROOM SUNDRIES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a floor rack, and more particularly to a floor rack which is designed to hold miscellaneous items in the bathroom.

BACKGROUND OF THE INVENTION

In light of space limitation of the bathroom in an office or private home, the bathroom sundry items are often kept in a disorderly manner that they cannot be easily found or reached by a user. As a remedial measure, a bathroom floor rack is a suitable adjunct to the bathroom.

BRIEF SUMMARY OF THE INVENTION

The primary objective of the present invention is to provide a floor rack for holding various bathroom items which are often used daily.

The floor rack of the present invention comprises a base, an upright support rod extending from the base, and a plurality of holders for holding bathroom sundries. The base is rested on a bathroom floor. The upright support rod is used to fasten the holders. The holders are detachably fastened with the upright support rod to facilitate the storing or shipping of the floor rack.

The features and the advantages of the present invention will be further elucidated hereinafter with reference to the accompanying drawings.

DETAILED DESCRIPTION OF THE INVENTION

Figure 1:
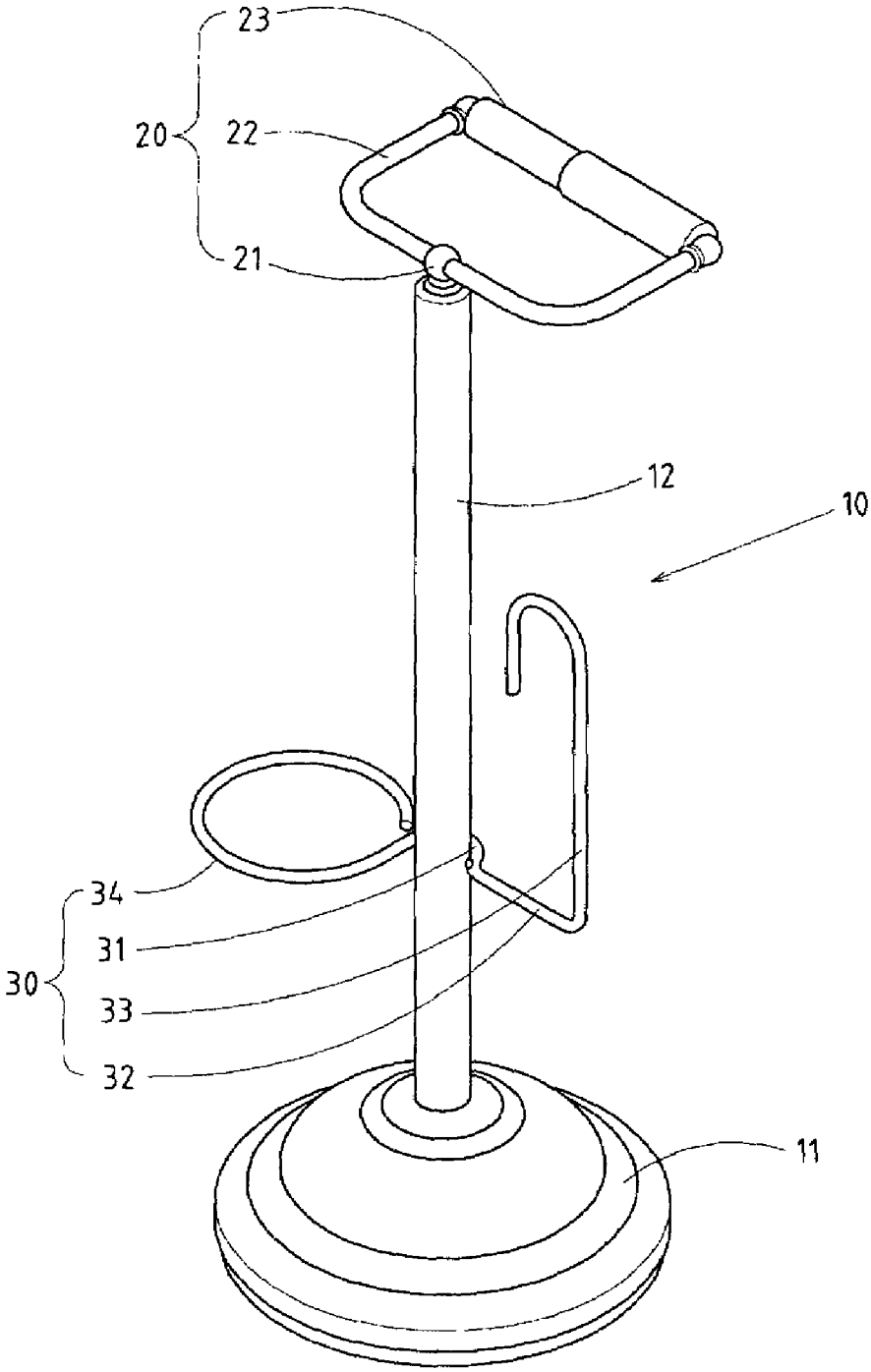
FIG. 1 shows a perspective view of a first preferred embodiment of the present invention.
Figure 2:
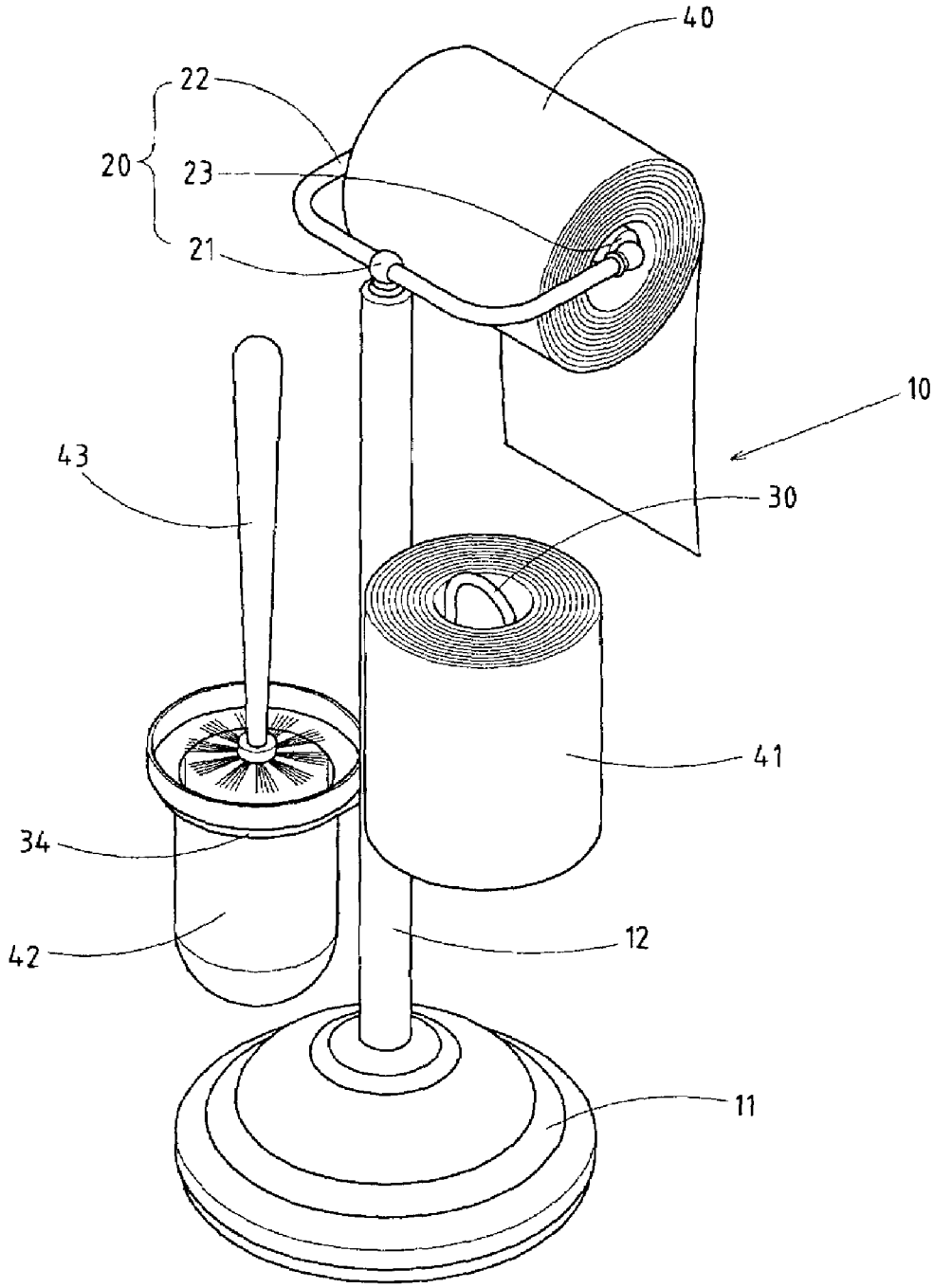
FIG. 2 shows a schematic view of the first preferred embodiment of the present invention at work.

As shown in FIGS. 1 and 2, a floor rack 10 embodied in the present invention comprises a base 11, an upright support rod 12, a first holder 20, and a second holder 30.

The base 10 is rested on the floor of a bathroom.

The upright support rod 12 is extended uprightly from the base 10 for supporting the first holder 20 and the second holder 30. The first holder 20 has a fastening portion 21, a support frame 22, and a holding rod 23. The fastening portion 21 is fastened with a top end of the upright support rod 12. The holding rod 23 is intended to hold a paper towel roll 40, as shown in FIG. 2.

The second holder 30 has a fastening portion 31, a support arm 32, a holding arm 33 extending from the support arm 32, and a ring 34. The second holder 30 is fastened with the outer wall of an appropriate level of the upright support rod 12 such that the fastening portion 31 is joined with the upright support rod 12 by welding. The holding arm 33 is used to hold a standby paper towel roll 41, while the ring 34 is used to hold a container 41 for holding a toilet-bowl brush 43, as shown in FIG. 2.

Figure 3:
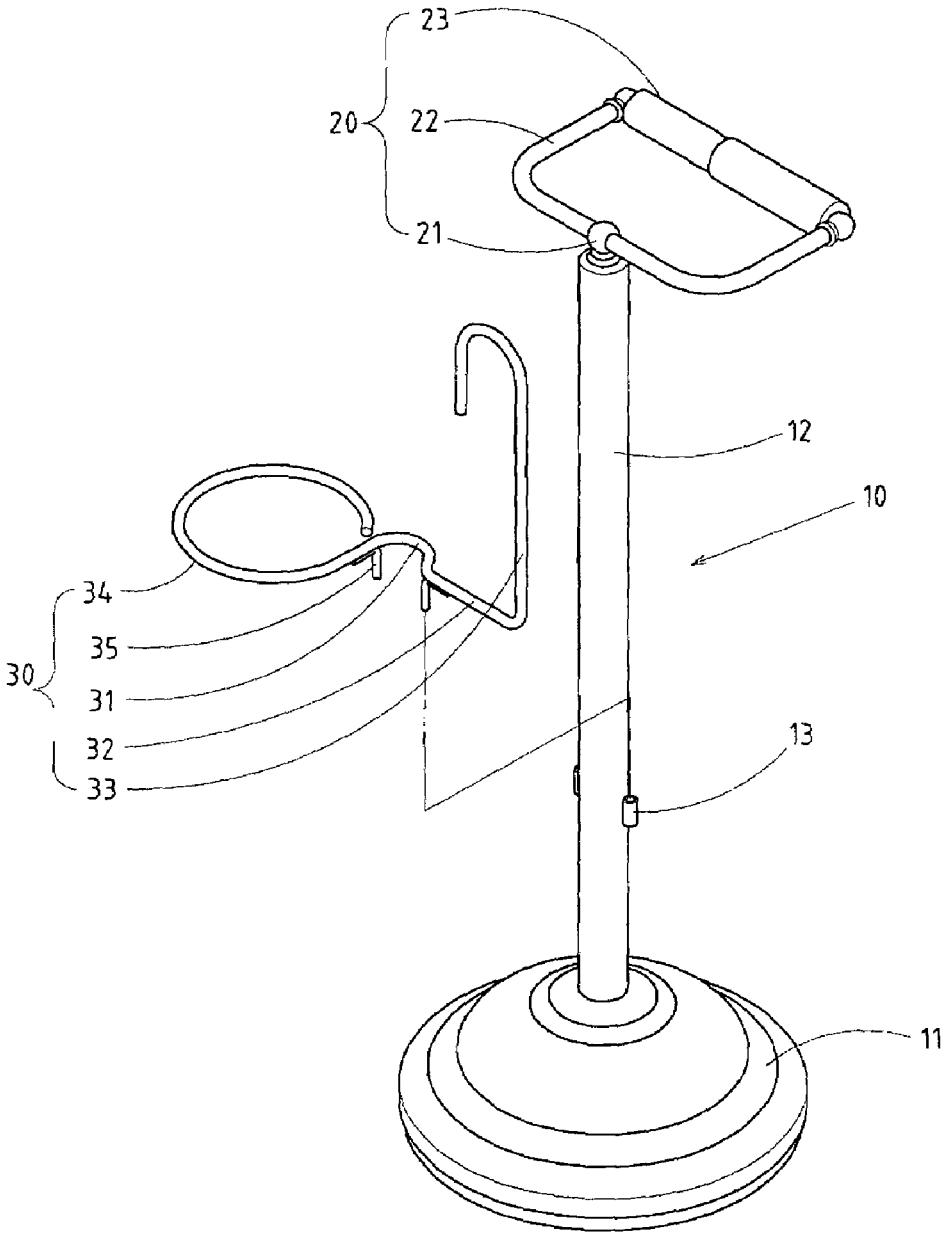
FIG. 3 shows a partial exploded perspective view of a second preferred embodiment of the present invention.
Figure 4:
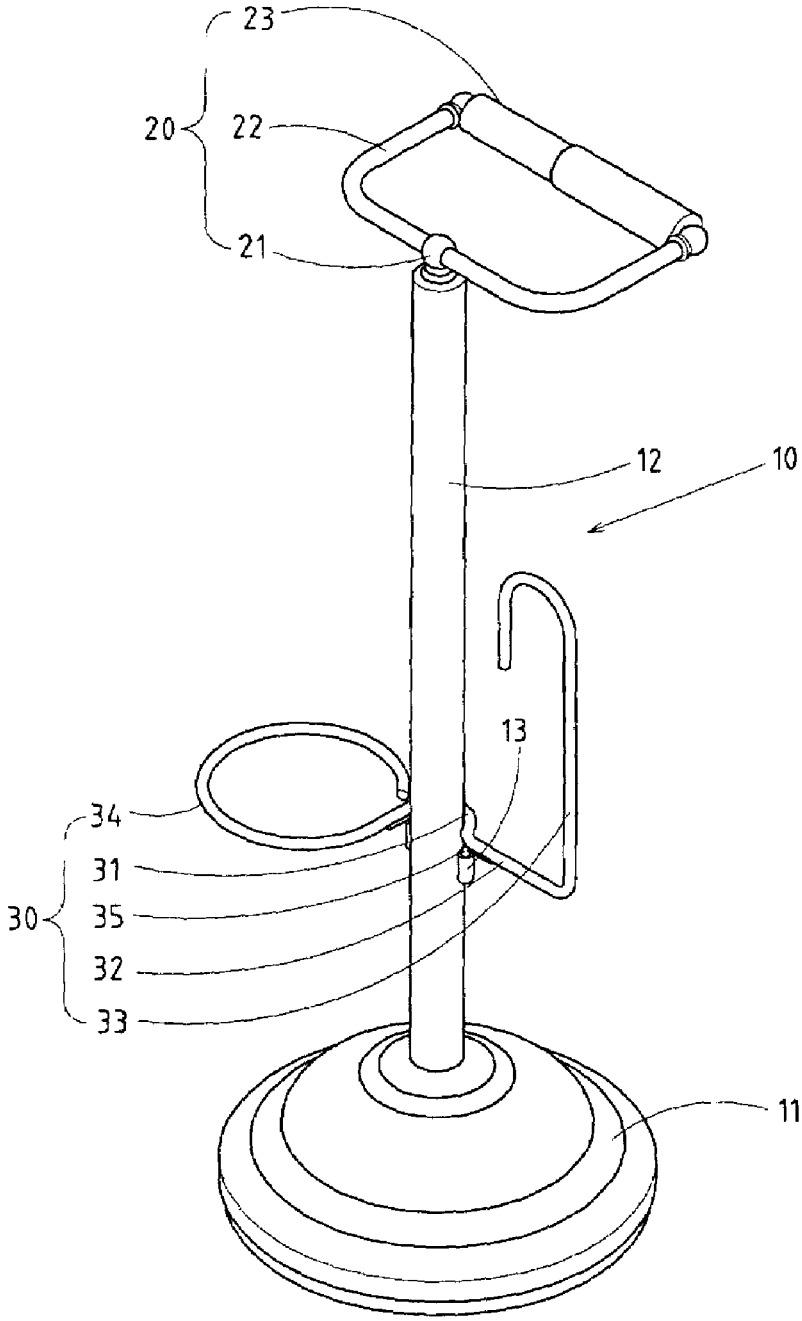
FIG. 4 shows a perspective view of the second preferred embodiment of the present invention.
Figure 5:
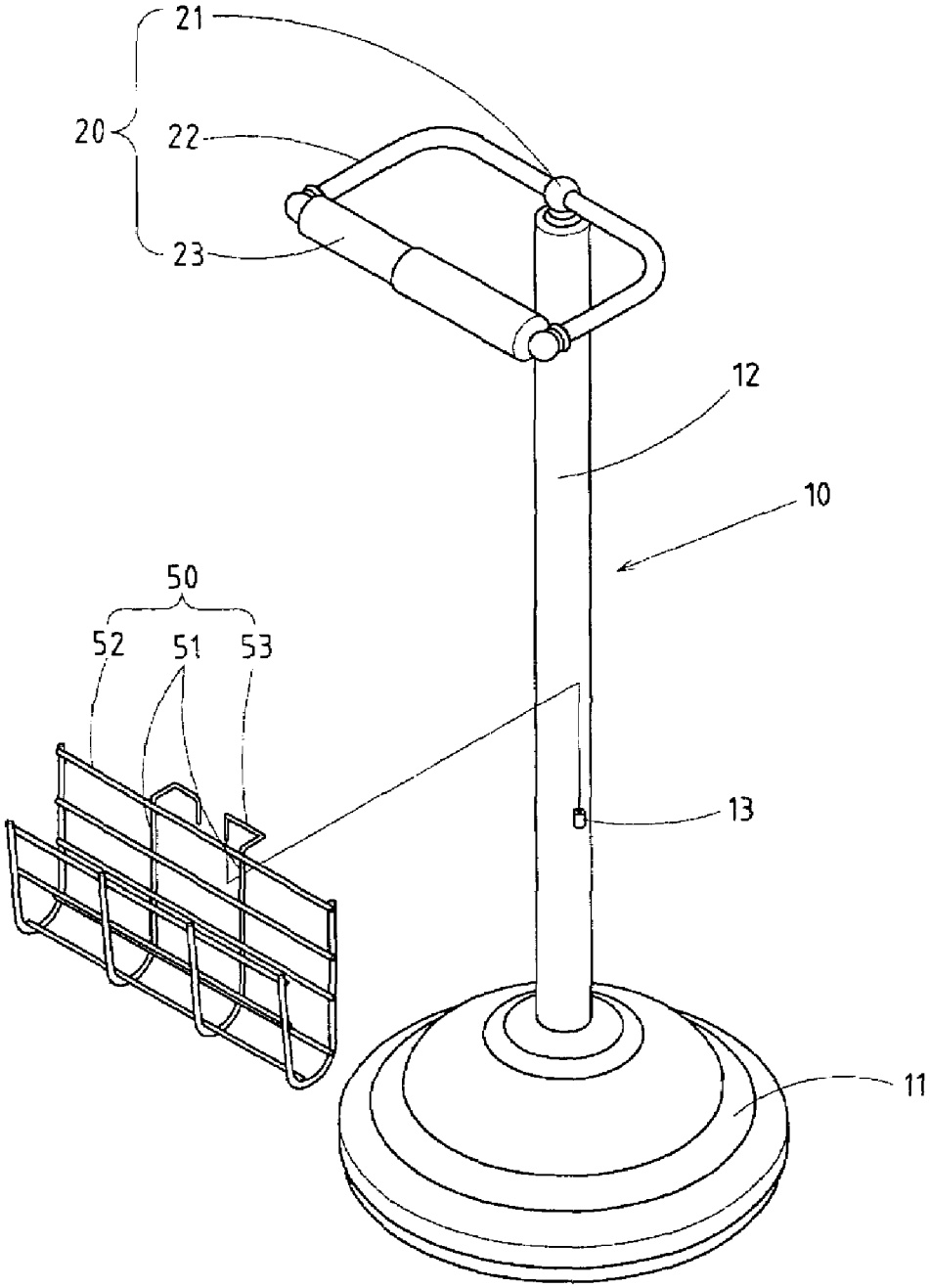
FIG. 5 shows a perspective view of a third preferred embodiment of the present invention.
Figure 6:
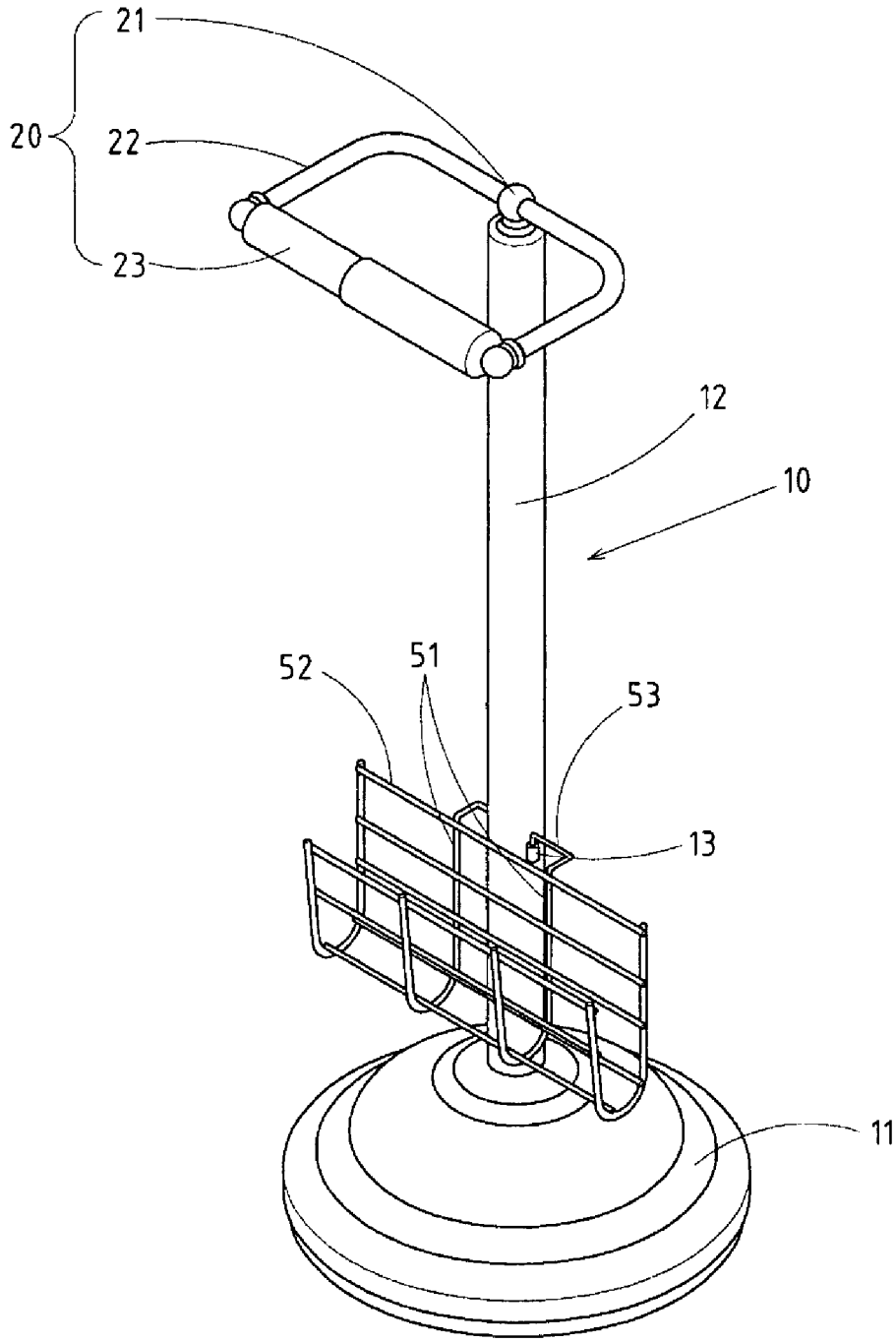
FIG. 6 shows a partial exploded perspective view of the third preferred embodiment of the present invention.

The second holder 30 may be detachably fastened with the upright support rod 12, as shown in FIGS. 3 and 4. The fastening portion 31 of the second holder 30 is provided with two retaining projections 35. Meanwhile, the upright support rod 12 is provided with two retaining slots 13. The second holder 30 is detachably fastened with the upright support rod 12 such that the two retaining projections 35 of the second holder 30 are removably retained in the two retaining slots 13 of the upright support rod 12.

As shown in FIGS. 5–8, the second holder 30 is replaced by a miscellaneous holder 50 for holding various articles 70. The miscellaneous holder 50 has a holding frame 52 and two support arms 51, each having a retaining projection 53. The miscellaneous holder 50 is detachably fastened with the upright support rod 12 such that the two retaining projections 53 are removably retained in the two retaining slots 13 of the upright support rod 12.

Figure 7:
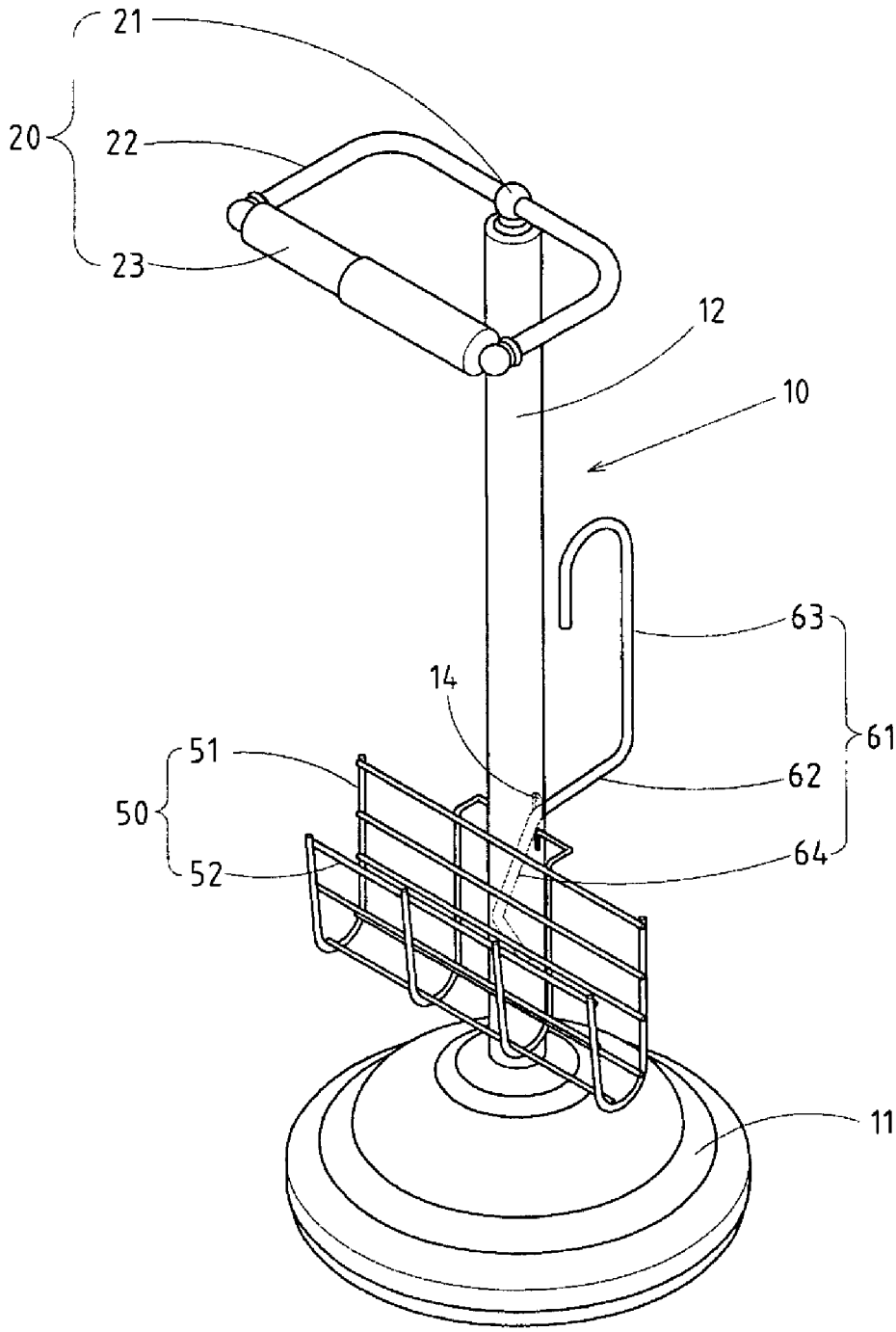
FIG. 7 shows a perspective view of a fourth preferred embodiment of the present invention.
Figure 8:
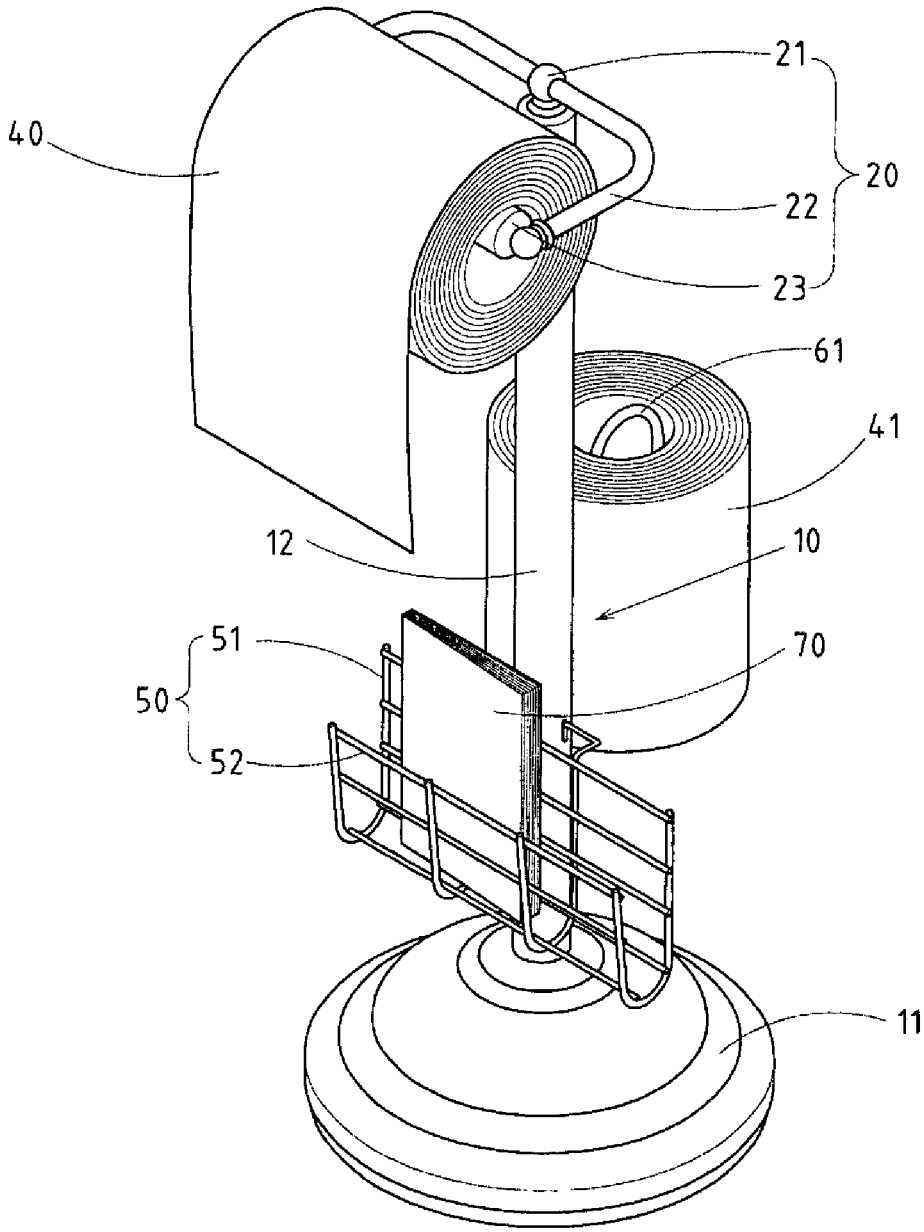
FIG. 8 shows a schematic view of the fourth preferred embodiment of the present invention at work.

As shown in FIGS. 7 and 8, the upright support rod 12 is provided with an insertion hole 14 and a roll holder 61. The roll holder 61 has a support arm 62, a holding arm 63, and a locating arm 64. The roll holder 61 is detachably fastened to the upright support rod 12 such that the locating arm 64 is removably located in a hollow interior of the upright support rod 12 via the insertion hole 14 of the upright support rod 12. The holding arm 63 of the roll holder 61 is used to hold a standby paper towel roll 41.

The embodiments of the present invention described above are illustrative and nonrestrictive. Accordingly, the present invention may be embodied in other specific forms without deviating from the spirit thereof. The present invention is therefore to be limited only by the scope of the following claims.

I claim:

1. A bathroom floor rack apparatus comprising:

a base;

an upright support rod affixed at one end to said base;

a first holder connected to an opposite end of said support rod, said first holder having a support frame fastened to said opposite end of said support rod, said first holder having a holding rod extending entirely between ends of said support frame, said holding rod having a diameter suitable for receiving a paper roll thereon in a condition suitable for dispensing paper therefrom;

a second holder fastened to said support rod between said first holder and said base, said second holder having a fastening portion affixed to said support rod, said second holder having a holding arm extending vertically upwardly from said fastening portion, and holding arm suitable for receiving another paper roll thereon, said second holder having a ring affixed to said fastening portion opposite said holding arm, said ring extending in a horizontal plane, said ring suitable for receiving a container therein.

2. The apparatus of claim 1, said support rod having an outer wall, said outer wall having a pair of retaining slots, said fastening portion of said second holder having a pair of retaining projections, said pair of retaining projections being removably retained by said pair of retaining slots.

3. The apparatus of claim 1, said support rod having a hollow interior, said support rod having an insertion hole in communication with said hollow interior, said fastening portion of said second holder having a locating portion extending into said hollow interior through said insertion hole.

* * * * *